US010504460B2

(12) United States Patent
Wu et al.

(10) Patent No.: US 10,504,460 B2
(45) Date of Patent: Dec. 10, 2019

(54) DISPLAY DEVICE AND IMAGE PROCESSING METHOD

(71) Applicant: HIMAX TECHNOLOGIES LIMITED, Tainan (TW)

(72) Inventors: Tung-Ying Wu, Tainan (TW); Yi-Hsiu Lin, Tainan (TW); Cheng-Che Tsai, Tainan (TW); Ming-Hung Weng, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 28 days.

(21) Appl. No.: 15/841,308

(22) Filed: Dec. 14, 2017

(65) Prior Publication Data

US 2019/0189065 A1 Jun. 20, 2019

(51) Int. Cl.
*G09G 3/14* (2006.01)
*G09G 3/36* (2006.01)

(52) U.S. Cl.
CPC ..... *G09G 3/3607* (2013.01); *G09G 3/3614* (2013.01); *G09G 2300/0443* (2013.01); *G09G 2310/08* (2013.01); *G09G 2320/029* (2013.01); *G09G 2320/0242* (2013.01); *G09G 2320/0626* (2013.01); *G09G 2320/0666* (2013.01)

(58) Field of Classification Search
CPC ..... G09G 3/3607; G09G 3/3614
See application file for complete search history.

(56) References Cited

U.S. PATENT DOCUMENTS 9,110,319 B2 8/2015 Tanaka et al.
2008/0106657 A1* 5/2008 Kitayama ..... G09G 3/3648 349/37
2011/0315991 A1* 12/2011 Sugihara ..... G02F 1/136286 257/59
2014/0098312 A1* 4/2014 Kitani ..... G02F 1/13306 349/41
2016/0148579 A1* 5/2016 Kimura ..... G09G 3/3607 345/694
2017/0103723 A1* 4/2017 Chen ..... G09G 3/3677

FOREIGN PATENT DOCUMENTS

CN 1799086 B 8/2010
CN 103310756 B 4/2016
CN 106154668 A 11/2016
WO WO-2006098448 A1 * 9/2006 ..... G09G 3/3648

* cited by examiner

*Primary Examiner* — Kwin Xie
(74) *Attorney, Agent, or Firm* — CKC & Partners Co., LLC

(57) ABSTRACT

The display device includes a circuit and multiple pixels. Each pixel includes multiple sub-pixels, and each sub-pixel includes a pixel electrode and a portion of a common electrode. A frame period includes a first polarity period and a second polarity period. The circuit maintains a voltage of the common electrode unchanged during the frame period, and applies a first dot inversion mode in the first polarity period and applies a second dot inversion mode in the second polarity period to the pixel electrodes. If determining that the input image has a bright stripe and the dark stripe adjacent to the each other, the circuit increases an intensity of the sub-pixel in an edge of the dark stripe or the bright stripe, and/or decrease an intensity of the middle sub-pixel in the bright stripe.

14 Claims, 12 Drawing Sheets

| | | | | | | | | | |
|---|---|---|---|---|---|---|---|---|---|
| 128 | 128 | 128 | 0 | 0 | 0 | 128 | 128 | 0 | 0 |
| 0 | 0 | 0 | 128 | 128 | 128 | 0 | 0 | 128 | 128 |
| 128 | 128 | 128 | 0 | 0 | 0 | 128 | 128 | 0 | 0 |
| 0 | 0 | 0 | 128 | 128 | 128 | 0 | 0 | 128 | 128 |

FIG. 5

DISPLAY DEVICE AND IMAGE PROCESSING METHOD

BACKGROUND

Field of Invention

The present invention relates to a display device and an image processing method. More particularly, the present invention relates to the display device and the image processing method in which a stripe pattern is detected and color shift is compensated.

Description of Related Art

A polarity inversion is generally performed in a liquid crystal display. If a voltage of a common electrode is fixed and the polarity inversion is performed on pixel electrodes, then the voltage of the common electrode may be shifted because of the coupling between the pixel electrodes and the common electrode. For example, FIG. 1 is a schematic diagram illustrating polarity inversion in accordance with prior art. Referring to FIG. 1, the voltage of a common electrode 110 remains unchanged, and the polarity inversion is performed on the pixel electrode 121-124. The symbol "+" represents that the voltage of the pixel electrode is higher than that of the common electrode; and the symbol "−" represents that the voltage of the pixel electrode is lower than that of the common electrode. In a first period, the polarities of the pixel electrode 121 and 123 are "+", and the polarities of the pixel electrodes 122 and 124 are "−". In a second period, the polarities of the pixel electrodes 121 and 123 are "−", and the polarities of the pixel electrodes 122 and 124 are "+". The pixel electrodes and the common electrode form capacitors. In general, if the electric potential of one end of a capacitor changes rapidly, then the electric potential of the other end of the capacitor will change correspondingly. Therefore, when the first period is switched to the second period, the voltage of the common electrode 110 may be shifted, resulting in color shift and bad display performance.

SUMMARY

Embodiments of the invention provide a display device including at least one circuit and multiple pixels. Each of the pixels includes multiple sub-pixels, and each of the sub-pixels includes a pixel electrode and a portion of a common electrode. A frame period includes a first polarity period and a second polarity period. The circuit maintains a voltage of the common electrode unchanged during the frame period, and applies a first dot inversion mode to the pixel electrodes of the sub-pixels in the first polarity period, and applies a second dot inversion mode to the pixels electrodes of the sub-pixels in the second polarity period. The first dot inversion mode is different from the second dot inversion mode. The circuit determines if an input image has a first bright stripe and a first dark stripe adjacent to each other. If determining that the input image has the first bright stripe and the first dark stripe adjacent to the each other, the circuit increases an intensity of the sub-pixel adjacent to the first dark stripe in the first bright stripe, or increases an intensity of one of the sub-pixels in the first dark stripe, or decrease an intensity of the sub-pixel not adjacent to the first dark stripe in the first bright stripe.

In some embodiments, the input image includes a first red sub-pixel, a first green sub-pixel, a first blue sub-pixel, a second red sub-pixel, a second green sub-pixel and a second blue sub-pixel which are sequentially disposed in a same row. The operation of the circuit determining if the input image has the first bright stripe and the first dark stripe adjacent to the each other includes: (a) calculating a maximum red value of the first red sub-pixel and the second red sub-pixel, calculating a maximum green value of the first green sub-pixel and the second green sub-pixel, calculating a maximum blue value of the first blue sub-pixel and the second blue sub-pixel, calculating a red absolute difference value between the first red sub-pixel and the second red sub-pixel, calculating a green absolute difference value between the first green sub-pixel and the second green sub-pixel, and calculating a blue absolute difference value between the first blue sub-pixel and the second blue sub-pixel; (b) determining if a maximum of the maximum red value, the maximum green value and the maximum blue value minus a minimum of the maximum red value, the maximum green value and the maximum blue value is less than or equal to a first threshold; (c) determining if a maximum of the red absolute difference value, the green absolute difference value and the blue absolute difference value minus a minimum of the red absolute difference value, the green absolute difference value and the blue absolute difference value is less than or equal to a second threshold; and (d) increasing a stripe counter if the step (b) and the step (c) are affirmative.

In some embodiments, the circuit calculates a gain value according to the stripe counter. The circuit increases the intensity of the sub-pixel adjacent to the first dark stripe in first bright stripe according to the gain value, or increases the intensity of the sub-pixel adjacent to the first bright stripe in the first dark stripe according to the gain value.

In some embodiments, the circuit inputs an absolute intensity difference between the first bright stripe and the first dark stripe into a lookup table to obtain a shift value, and multiplies the shift value by the gain value to obtain a modified shift value. The circuit increases the intensity of the sub-pixel adjacent to the first dark stripe in first bright stripe according to the modified shift value, or increases the intensity of the sub-pixel adjacent to the first bright stripe in the first dark stripe according to the modified shift value.

In some embodiments, the circuit sets the intensity of the sub-pixel not adjacent to the first dark stripe in the first bright stripe according to the intensity of the sub-pixel adjacent to the first dark stripe in first bright stripe. The circuit sets the intensity of the sub-pixel not adjacent to the first bright stripe in the first dark stripe according to the intensity of the sub-pixel adjacent to the first bright stripe in the first dark stripe.

In some embodiments, the circuit determines if the input image has the first bright stripe, the first dark stripe and a second bright stripe, wherein the first dark stripe is located between the first bright stripe and the second bright stripe. If determining that the input image has the first bright stripe, the first dark stripe and the second bright stripe, the circuit increase an intensity of the sub-pixel adjacent to the first dark stripe in the second bright stripe, or increases an intensity of the sub-pixel adjacent to the second bright stripe in the first dark stripe, or decreases an intensity of the sub-pixel not adjacent to the first dark stripe in the second bright stripe.

In some embodiments, the circuit sets the intensity of the sub-pixel not adjacent to the first dark stripe in the first bright stripe according to the intensity of the sub-pixel adjacent to the first dark stripe in first bright stripe. Alternatively, the circuit sets an intensity of the sub-pixel not adjacent to the first bright stripe and the second bright stripe in the first dark stripe according to an intensity of the sub-pixel adjacent to the first bright stripe or the second bright stripe in the first dark stripe. Alternatively, the circuit sets the intensity of the sub-pixel not adjacent to the first bright stripe in the second bright stripe according to an intensity of the sub-pixel adjacent to the first dark stripe in the second bright stripe.

In some embodiments, the input image includes a first red sub-pixel, a first green sub-pixel, a first blue sub-pixel, a second red sub-pixel, a second green sub-pixel, a second blue sub-pixel, a third red sub-pixel, a third green sub-pixel and a third blue sub-pixel which are sequentially disposed in a same row. The operation of the circuit determining if the input image has the first bright stripe, the first dark stripe and the second bright stripe includes: (a') calculating a maximum red value of the first red sub-pixel and the second red sub-pixel, calculating a maximum green value of the first green sub-pixel and the second green sub-pixel, calculating a maximum blue value of the first blue sub-pixel and the second blue sub-pixel, calculating a first red absolute difference value between the first red sub-pixel and the second red sub-pixel, calculating a first green absolute difference value between the first green sub-pixel and the second green sub-pixel, calculating a first blue absolute difference value between the first blue sub-pixel and the second blue sub-pixel, calculating a second red absolute difference value between the first red sub-pixel and the third red sub-pixel, calculating a second green absolute difference value between the first green sub-pixel and the third green sub-pixel, and calculating a second blue absolute difference value between the first blue sub-pixel and the third blue sub-pixel; (b') determining if a maximum of the maximum red value, the maximum green value and the maximum blue value minus a minimum of the maximum red value, the maximum green value and the maximum blue value is less than or equal to a first threshold; (c') determining if a maximum of the first red absolute difference value, the first green absolute difference value and the first blue absolute difference value minus a minimum of the first red absolute difference value, the first green absolute difference value and the first blue absolute difference value is less than or equal to a second threshold; (d') determining if the second red absolute difference value is less than or equal to a third threshold; (e') determining if the second green absolute difference value is less than or equal to the third threshold; (f') determining if the second blue absolute difference value is less than or equal to the third threshold; and (g') increasing a stripe counter if the step (b') to the step (f') are all affirmative.

In some embodiments, the circuit calculates a gain value according to the stripe counter. The circuit increases the intensity of the sub-pixel adjacent to the first dark stripe in first bright stripe according to the gain value, or increases the intensity of the sub-pixel adjacent to the first bright stripe in the first dark stripe according to the gain value, or increases the intensity of the sub-pixel adjacent to the second bright stripe in the first dark stripe according to the gain value, or increases the intensity of the sub-pixel adjacent to the first dark stripe in the second bright stripe according to the gain value.

In some embodiments, each of the pixels includes n sub-pixels, n is a positive integer, and both widths of the first bright stripe and the first dark stripe are equal to the positive integer n.

In some embodiments, the at least one circuit is a timing controller.

From another aspect, embodiments of the invention provide an image processing method for the display device including multiple pixels. Each of the pixels includes multiple sub-pixels. Each of the sub-pixels includes a pixel electrode and a portion of a common electrode. A frame period includes a first polarity period and a second polarity period. The image processing method includes: maintaining a voltage of the common electrode unchanged during the frame period, applying a first dot inversion mode to the pixel electrodes of the sub-pixels in the first polarity period, and applying a second dot inversion mode to the pixels electrodes of the sub-pixels in the second polarity period, wherein the first dot inversion mode is different from the second dot inversion mode; determine if an input image has a first bright stripe and a first dark stripe adjacent to each other; and if determining that the input image has the first bright stripe and the first dark stripe adjacent to the each other, increasing an intensity of the sub-pixel adjacent to the first dark stripe in the first bright stripe, or increasing an intensity of one of the sub-pixels in the first dark stripe, or decreasing an intensity of the sub-pixel not adjacent to the first dark stripe in the first bright stripe.

BRIEF DESCRIPTION OF THE DRAWINGS

The invention can be more fully understood by reading the following detailed description of the embodiment, with reference made to the accompanying drawings as follows.

FIG. 5 is a diagram illustrating intensities of the input image in accordance with an embodiment.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

The using of "first", "second", "third", etc. in the specification should be understood for identifying units or data described by the same terminology, but are not referred to particular order or sequence.

Figure 1:
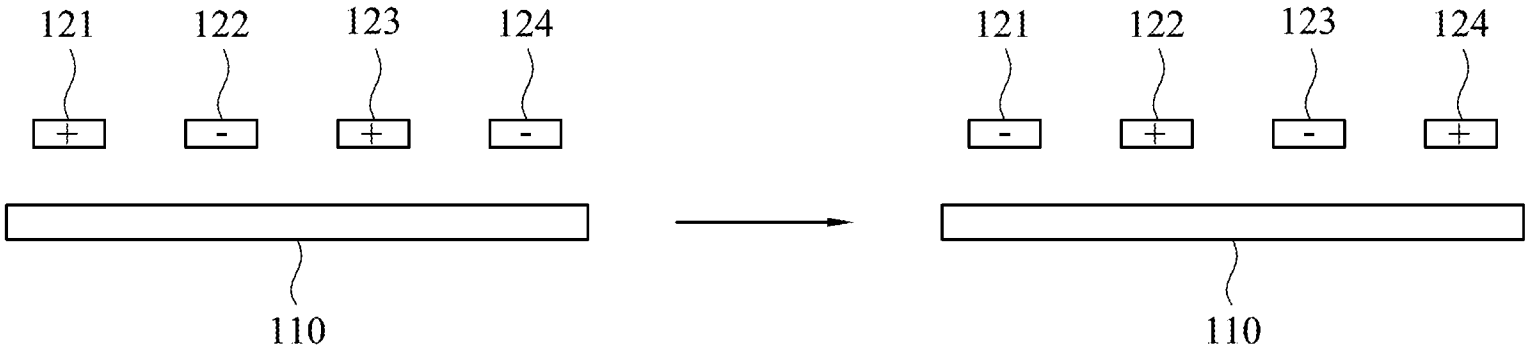
FIG. 1 (PRIOR ART)
FIG. 1 is a schematic diagram illustrating polarity inversion in accordance with prior art.
Figure 2:
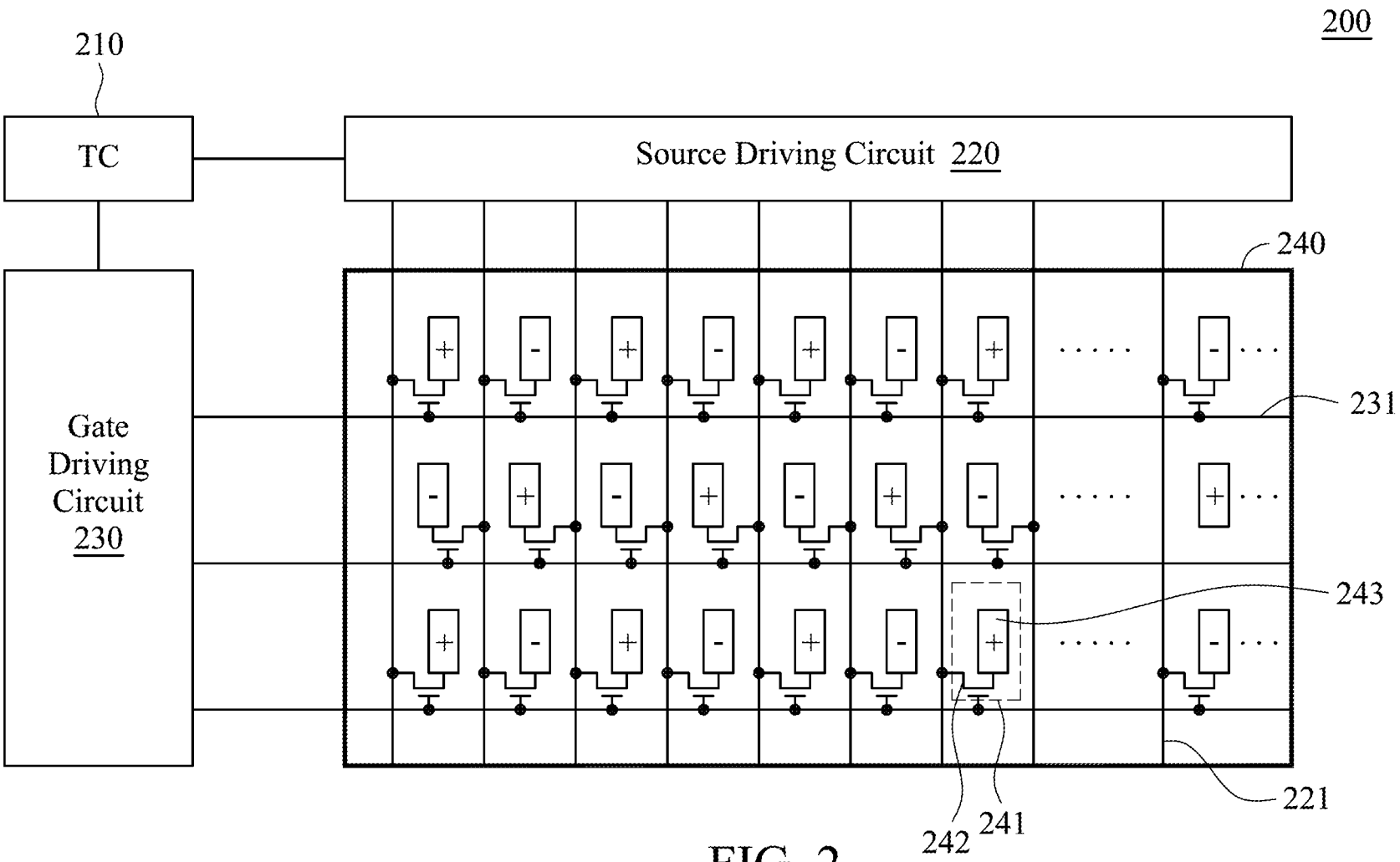
FIG. 2 is a schematic diagram illustrating a display device in accordance with an embodiment.

FIG. 2 is a schematic diagram illustrating a display device in accordance with an embodiment. Referring to FIG. 2, a display device 200 includes a timing controller 210, a source driving circuit 220, a gate driving circuit 230 and a display panel 240. The display panel 240 includes multiple gate lines (e.g. a gate line 231), multiple data lines (e.g. a data line 221) and multiple sub-pixels (e.g. a sub-pixel 241). Each sub-pixel includes a thin film transistor (TFT) such as the TFT 242 and a pixel electrode such as a pixel electrode 243. For simplification, not all gate lines, data lines, sub-pixels, TFTs and pixel electrodes are labeled in FIG. 2. In addition, the display panel 240 also includes a common electrode (not shown) which is disposed across the sub-pixels. In other words, each sub-pixel includes a portion of the common electrode. An electric field between the pixel electrode and the common electrode is configured to change the orientation of liquid crystal (not shown). Z-inversion is adopted in the embodiment of FIG. 2, but the invention is not limited thereto. In other embodiments, the sub-pixels in the same column may be coupled to the same data line.

The voltage of the common electrode remains unchanged, and polarity inversion is performed on the pixel electrodes. The polarity of each pixel electrode at one time point is shown in FIG. 2. The symbol "+" in the pixel electrode represents that the voltage of the pixel electrode is higher than that of the common electrode; the symbol "−" in the pixel electrode represents that the voltage of the pixel electrode is lower than that of the common electrode. The timing controller 210 may decide the polarity of each sub-pixel.

Figure 3A:
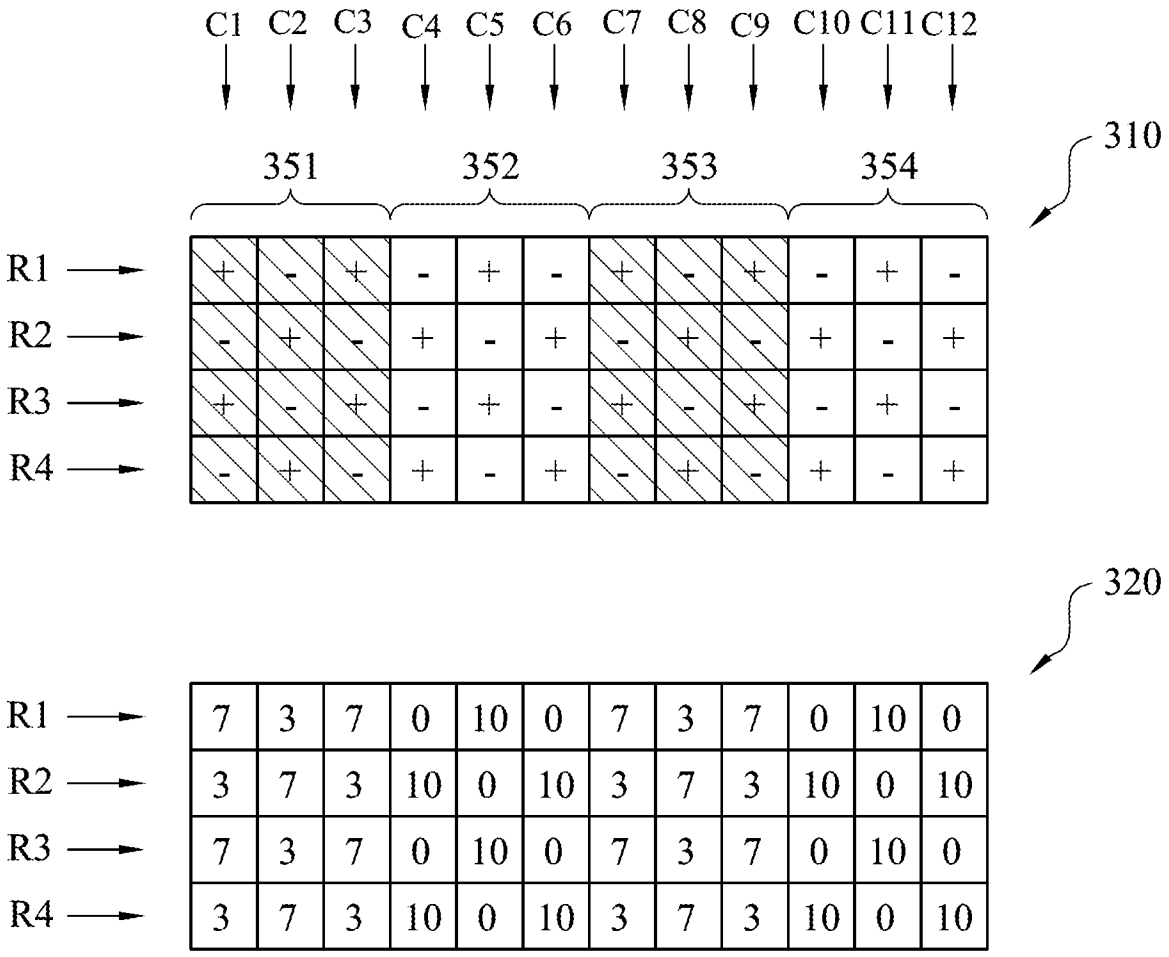
FIG. 3A is a diagram illustrating the voltage and polarity of each sub-pixel in the first polarity period.
Figure 3B:
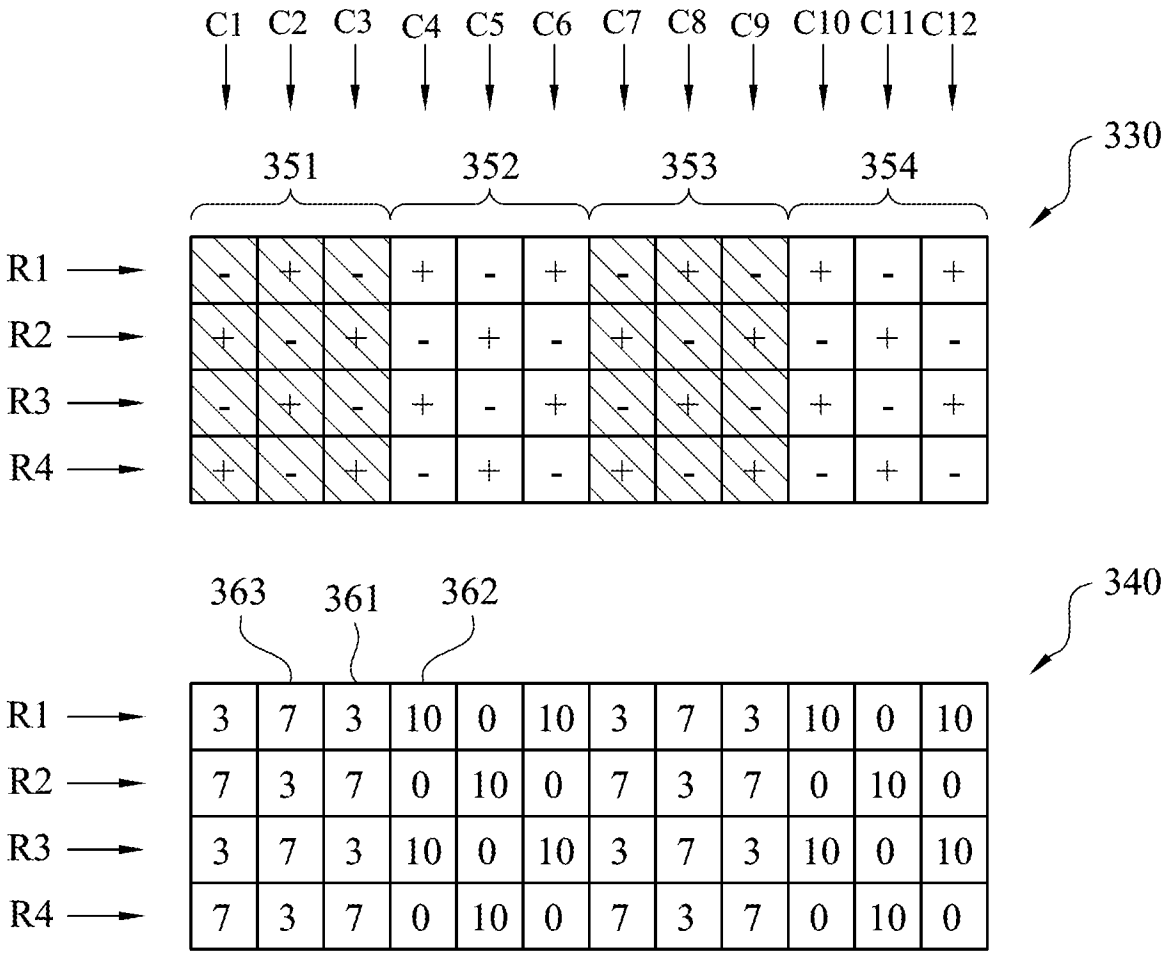
FIG. 3B is a diagram illustrating the voltage and polarity of each sub-pixel in the second polarity period.

In detail, a frame period includes a first polarity period and a second polarity period. FIG. 3A is a diagram illustrating the voltage and polarity of each sub-pixel in a first polarity period, and FIG. 3B is a diagram illustrating the voltage and polarity of each sub-pixel in a second polarity period. Tables 310 and 330 show the polarities. Tables 320 and 340 show the voltages of the pixel electrodes. Forty-eight sub-pixels are shown in FIG. 3A and FIG. 3B, and these sub-pixels are arranged as rows R1-R4 and columns C1-C12. The timing controller 210 would obtain an input image including intensities of each sub-pixel. In the embodiments of FIG. 3A and FIG. 3B, the input image has a stripe pattern having bright stripes 351, 353, and dark stripes 352 and 354. The intensity of each sub-pixel in the bright stripes 351 and 353 is 128. The intensity of each sub-pixel in the dark stripes 352 and 354 is 0. The voltage of the common electrode remains 5 volts(V). The voltage of each pixel electrode is determined in accordance with the polarity and the intensity of each sub-pixel. In detail, the relationship between the intensities and the polarities is shown in the following Table 1.

TABLE 1

| | polarity | |
|---|---|---|
| intensity | + | − |
| 128 | 7 V | 3 V |
| 0 | 10 V | 0 V |

When the polarity is "+" and the intensity is 128, the voltage of the pixel electrode is set as 7V; when the polarity is "+" and the intensity is 0, the voltage of the pixel electrode is set as 10V; when the polarity is "−" and the intensity is 128, the voltage of the pixel electrode is set as 3V; and when the polarity is "−" and the intensity is 0, the voltage of the pixel electrode is set as 0V.

In the first polarity period, the timing controller 210 applies a first dot inversion mode to the pixel electrodes of the sub-pixels, in which the detailed polarities are shown in the table 310 of FIG. 3A. In the second polarity period, the timing controller 210 applies a second dot inversion mode the pixel electrodes of the sub-pixels, in which the detailed polarities are shown in the table 330 of FIG. 3B. Basically, the first dot inversion mode is inverted from the second dot inversion mode. If the polarity of one sub-pixel is "+" in the first dot inversion mode, then it is "−" in the second dot inversion mode.

Note that when first polarity period is switched into a second polarity period, the voltages of the pixel electrodes change rapidly, and therefore the voltage of the common electrode may change due to the capacitor coupling. For example, a voltage summation of the row R1 in the table 320 minus a voltage summation of the row R1 in the table 330 is $(17\times2+20)-(13*2+40)=-12V$ which means a voltage variation on one end (i.e. pixel electrode) of the capacitor. The greater an absolute of the voltage variation is, the more the other end (i.e. common electrode) of the capacitor is affected. On the other hand, the brightness of the sub-pixel at the boundary between the bright stripe and the dark stripe may be shifted. Take the sub-pixels 361 and 362 as an example, the sub-pixel 361 is in the bright stripe 351, and the voltage thereof changes from 7V to 3V; but the sub-pixel 362 is in the dark stripe 352, and the voltage thereof changes from 0V to 10V. Due to the capacitor coupling, the voltage of the common electrode around the sub-pixel 362 arises so that the voltage of the pixel electrode of the sub-pixel 361 effectively drops, resulting in that the visual brightness is decreased. In addition, the sub-pixel 363 may not be affected by the capacitor coupling relatively because the sub-pixels around the sub-pixel 363 are all in the bright stripe 351. Therefore, from another aspect, the larger the intensity difference between the bright stripe 351 and the dark stripe 352 is, the more the sub-pixel at the boundary between the bright stripe 351 and the dark stripe 352 is affected because of the capacitor coupling.

Figure 4:
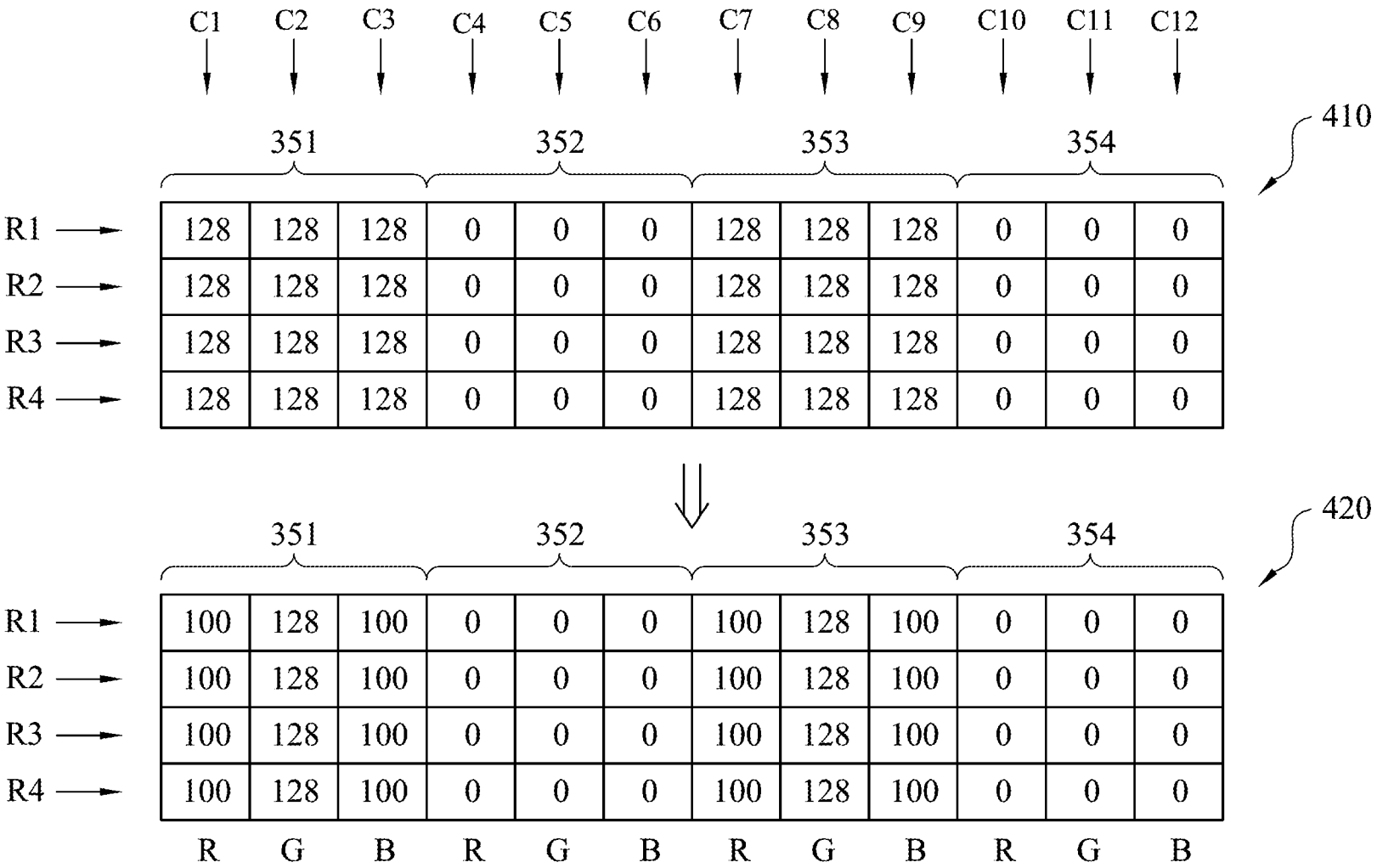
FIG. 4 is diagram illustrating visual intensities of the sub-pixels in accordance with the embodiments of FIG. 3A and FIG. 3B.

FIG. 4 is diagram illustrating visual intensities of the sub-pixels in accordance with the embodiments of FIG. 3A and FIG. 3B. Referring to FIG. 4, the intensities of the original input image are shown in a table 410. The visual intensities are shown in a table 420 due to the aforementioned capacitor coupling. The visual intensities of the sub-pixels, which are adjacent to the dark stripe 352, in the bright stripe 351 are decreased from 128 to 100, but the visual intensities of the sub-pixels in the middle of the bright stripe 351 remain the same. Similarly, the intensities of the sub-pixels adjacent to dark stripes 352 and 354 in the bright stripe 353 are decreased from 128 to 100, but the visual intensities of the sub-pixels in the middle of the bright stripe 353 remain the same. On the other hand, each sub-pixel is configured to render a respective color. In the embodiment, the sub-pixels in the column C1 render red (labeled as R), the sub-pixels in the column C2 render green (labeled as G), and the sub-pixels in the column C3 render blue (labeled as B), and so on. Therefore, the intensities of the table 410 are configured to render a grey stripe 351 and a black stripe 352; but the stripe 351 in the table 420 would be greenish.

In the embodiment, 3 sub-pixels associated with red, green, and blue constitute one pixel, and widths of the bright stripes 351, 353 and the dark stripes 352, 354 are all equal to 3. However, in other embodiments, one pixel may include n sub-pixels, in which n is a positive integer, and the widths of the bright stripes 351, 353 and the dark stripes 352, 354 are equal to the positive integer n that may also incurs the color shift as will. For example, each pixel includes 4 sub-pixels of red, green, blue, and white while the input image has a bright stripe and a dark stripe which widths are equal to 4 and are adjacent to each other. In this example, the situation of color shift also occurs. Alternatively, each pixel may include 4 sub-pixels of red, green, blue, and yellow. In other embodiments, the widths of the bright stripe and the dark stripe may be equal to k×n, in which k is a positive integer representing the number of the pixels included in one bright stripe or one dark stripe. In some embodiments, the width of the bright stripe may be different from that of the dark stripe. For example, the width of the bright stripe is equal to 2n, and the width of the dark stripe is equal to n.

In the embodiment of FIG. 4, heights of the bright stripes 351, 353 and the dark stripes 352, 354 are equal to 4. However, the bright stripes 351, 353 and the dark stripes 352, 354 may have arbitrary heights. For example, FIG. 5 is a diagram illustrating intensities of the input image in accordance with an embodiment. In the embodiment of FIG. 5, each of the bright stripes and the dark stripes has a width of 3 and a height of 1, and every bright stripe would be greenish in this case. The heights of the bright stripe and the dark stripe are not limited in the invention.

In the embodiment, the timing controller 210 determines if the input image has a first bright stripe and a first dark stripe adjacent to each other. If determining that the input image has the first bright stripe and the first dark stripe adjacent to the each other, the timing controller 210 increase the intensity of the sub-pixel adjacent to the first dark stripe in the first bright stripe, or increases the intensity of at least one sub-pixel in the first dark stripe, or decreases the intensity of the sub-pixel not adjacent to the first dark stripe in the first bright stripe. For example, in the embodiment of FIG. 4, the timing controller 210 increases the intensities of the sub-pixels in the column C3, or increases the intensities of the sub-pixels in the column C4, or decreases the intensities of the sub-pixels in the column C2. The adjustments of the intensities would alleviate the greenish phenomenon. Note that the increasing of the intensities of the sub-pixels in the column C4 reduces the capacitor coupling, and therefore effectively the intensities of the sub-pixels in the column C3 would not be decreased. The aforementioned operations are performed by the timing controller 210 in this embodiment, but they may be performed by any circuit in the display device in other embodiments, which is not limited in the invention. Several embodiments will be provided below to describe how the bright stripe/dark stripe is detected, and how the intensities are adjusted.

Figure 6:
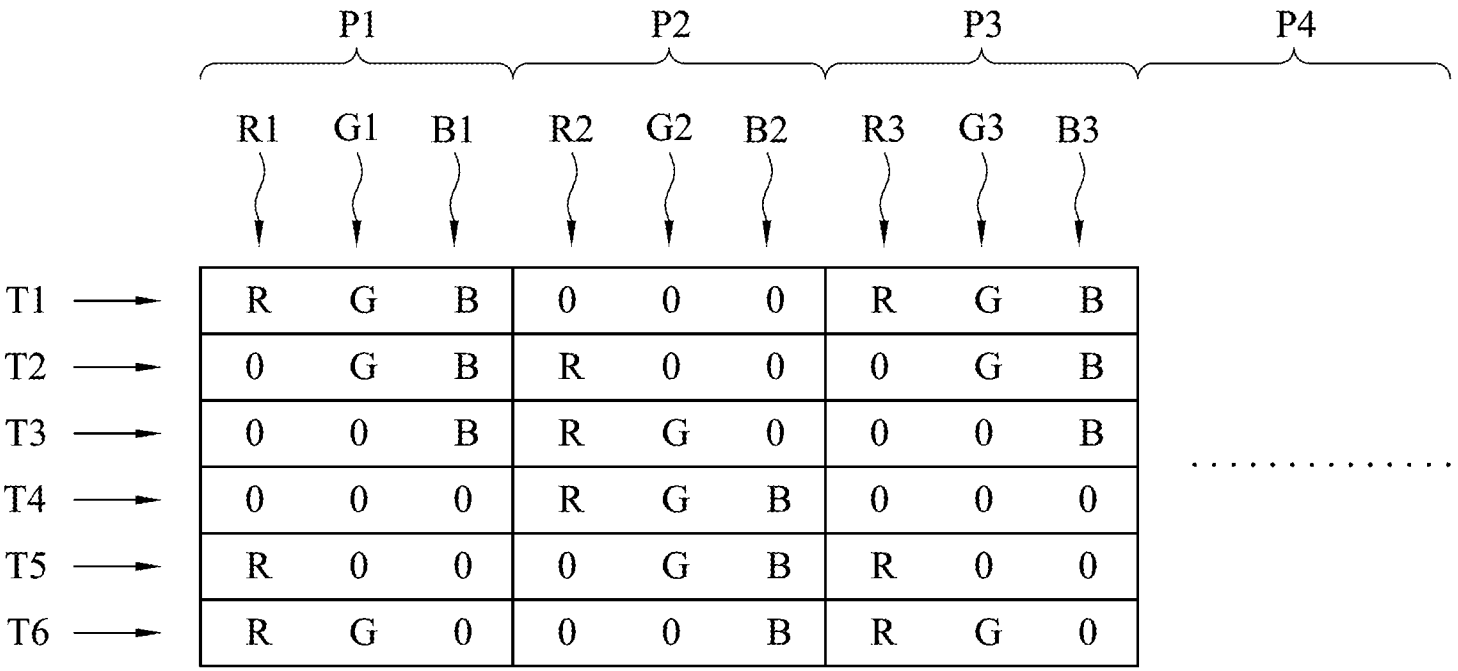
FIG. 6 is a diagram illustrating detection of the bright stripe and the dark stripe in accordance with an embodiment.

FIG. 6 is a diagram illustrating detection of the bright stripe and the dark stripe in accordance with an embodiment. Referring to FIG. 6, a first red sub-pixel R1, a first green sub-pixel G1, a first blue sub-pixel B1, a second red sub-pixel R2, a second green sub-pixel G2, a second blue sub-pixel B2, a third red sub-pixel R3, a third green sub-pixel G3 and a third blue sub-pixel B3 are sequentially disposed in the same row. The red sub-pixel R1, the green sub-pixel G1, and the blue sub-pixel B1 constitute a pixel P1. The red sub-pixel R2, the green sub-pixel G2, and the blue sub-pixel B2 constitute a pixel P2. The red sub-pixel R3, the green sub-pixel G3, and the blue sub-pixel B3 constitute a pixel P3. The pixels P1-P3 have different intensities in different types T1-T6 which represent that the bright stripe/dark stripe has different location shifts. In FIG. 6, "R", "G", and "B" mean the intensities (e.g. 128, but not limited thereto) of the bright stripe; and "0" means the intensities of the dark stripe (0 is just an example). For instance, in the type T1, the red sub-pixel R1, the green sub-pixel G1, and the blue sub-pixel B1 have relatively higher intensities; the red sub-pixel R2, the green sub-pixel G2, and the blue sub-pixel B2 have relatively lower intensities; and the red sub-pixel R3, the green sub-pixel G3, and the blue sub-pixel B3 have relatively higher intensities. The bright stripe and the dark stripe in the type T2 is right-shifted with respect to the type T1, and so on. Six sub-pixel are taken as a block to determine if there are bright stripe and dark stripe in this embodiment. For example, the six sub-pixels R1 to B2 are first taken as the block. The determining procedure in the embodiment can detect the types T1-T6 simultaneously and includes steps (a)-(d) which will be described in detail in the following paragraphs.

In the step (a), a maximum red value MaxR=Max(R1,R2) is calculated for the red sub-pixel R1 and the red sub-pixel R2; a maximum green value MaxG=Max(G1,G2) is calculated for the green sub-pixel G1 and the green sub-pixel G2; a maximum blue value MaxB=Max(B1,B2) is calculated for the blue sub-pixel B1 and the blue sub-pixel B2. Next, a red absolute difference value Diff_R1=abs(R1−R2) is calculated between the red sub-pixel R1 and the red sub-pixel R2; a green absolute difference value Diff_G1=abs(G1−G2) is calculated between the green sub-pixel G1 and the green sub-pixel G2; a blue absolute difference value Diff_B1=abs (B1−B2) is calculated between the blue sub-pixel B1 and the blue sub-pixel B2. Max( ) represents a maximum function, and abs( ) represents an absolute function.

In the step (b), it is determined whether a maximum of the maximum red value MaxR, the maximum green value MaxG and the maximum blue value MaxB minus a minimum of the maximum red value MaxR, the maximum green value MaxG and the maximum blue value MaxB is less than or equal to a first threshold. The step (b) can be presented as pseudocode: if(Max(MaxR, MaxG, MaxB)−Min(MaxR, MaxG, MaxB))<=Th1, where Th1 is the first threshold.

In the step (c), it is determined whether a maximum of the red absolute difference value Diff_R1, the green absolute difference value Diff_G1 and the blue absolute difference value Diff_B1 minus a minimum of the red absolute difference value Diff_R1, the green absolute difference value Diff_G1 and the blue absolute difference value Diff_B1 is less than or equal to a second threshold. The step (c) can be presented as pseudocode: if((Max(Diff_R1,Diff_G1, Diff_B1)−Min(Diff_R1,Diff_G1,Diff_B1))<=Th2), where Th2 is the second threshold.

In the step (d), it is determined whether the step (b) and the step (c) are affirmative. If the step (b) and the step (c) are both affirmative, a stripe counter is increased.

After the steps (a) to (d) are performed, the block constitute by the 6 sub-pixels is shifted to the right, and then the steps (a) to (d) are performed on the pixels P3 and P4. When performing the steps (a) to (d) on the pixel P3 and P4, the sub-pixels R1, G1 and B1 written in the pseudocodes above mean the sub-pixels of the pixel P3, and so on.

Figure 7A:
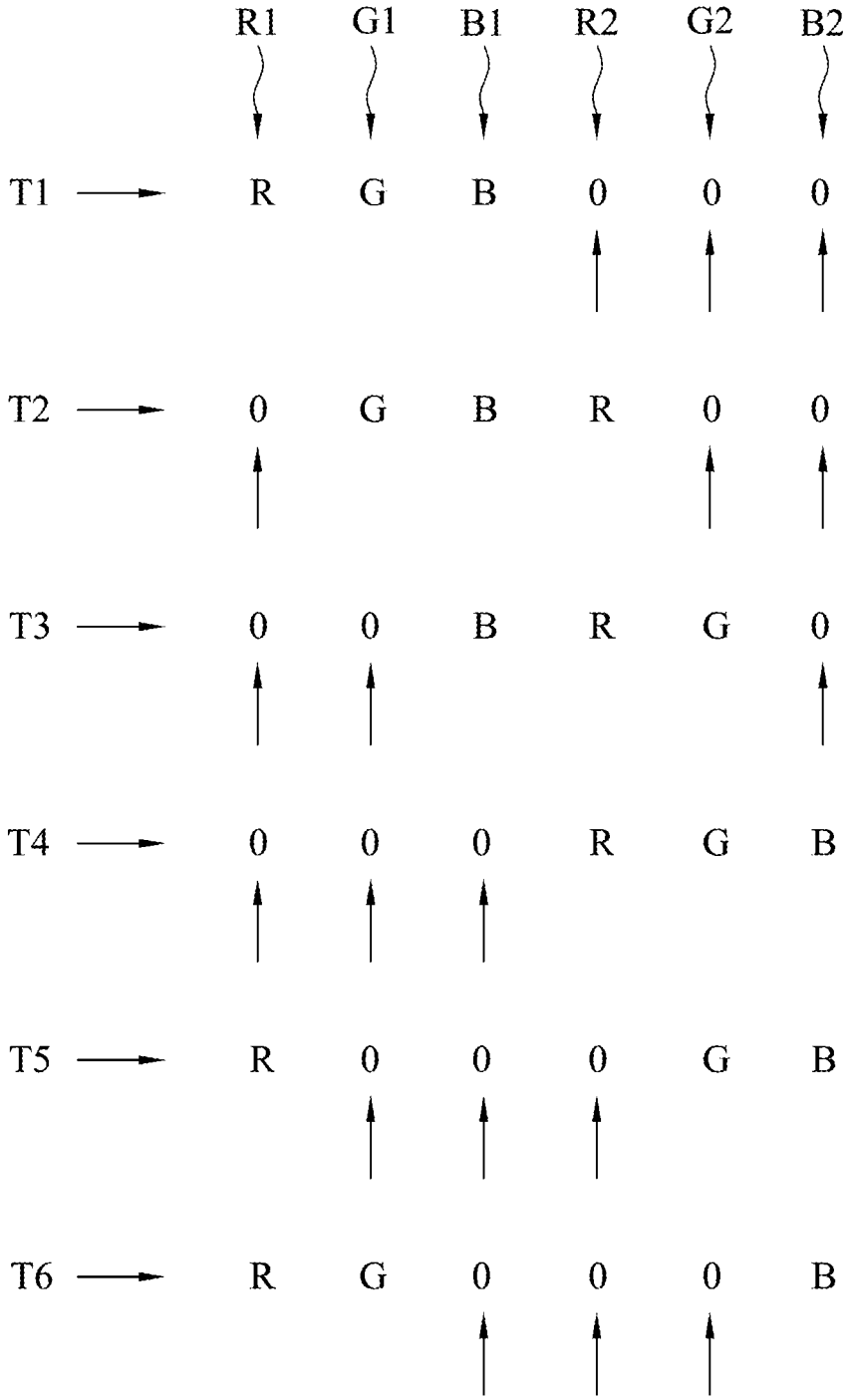
FIG. 7A and FIG. 7B are diagram illustrating the adjustment of the intensities of the sub-pixels in accordance with an embodiment.
Figure 7B:
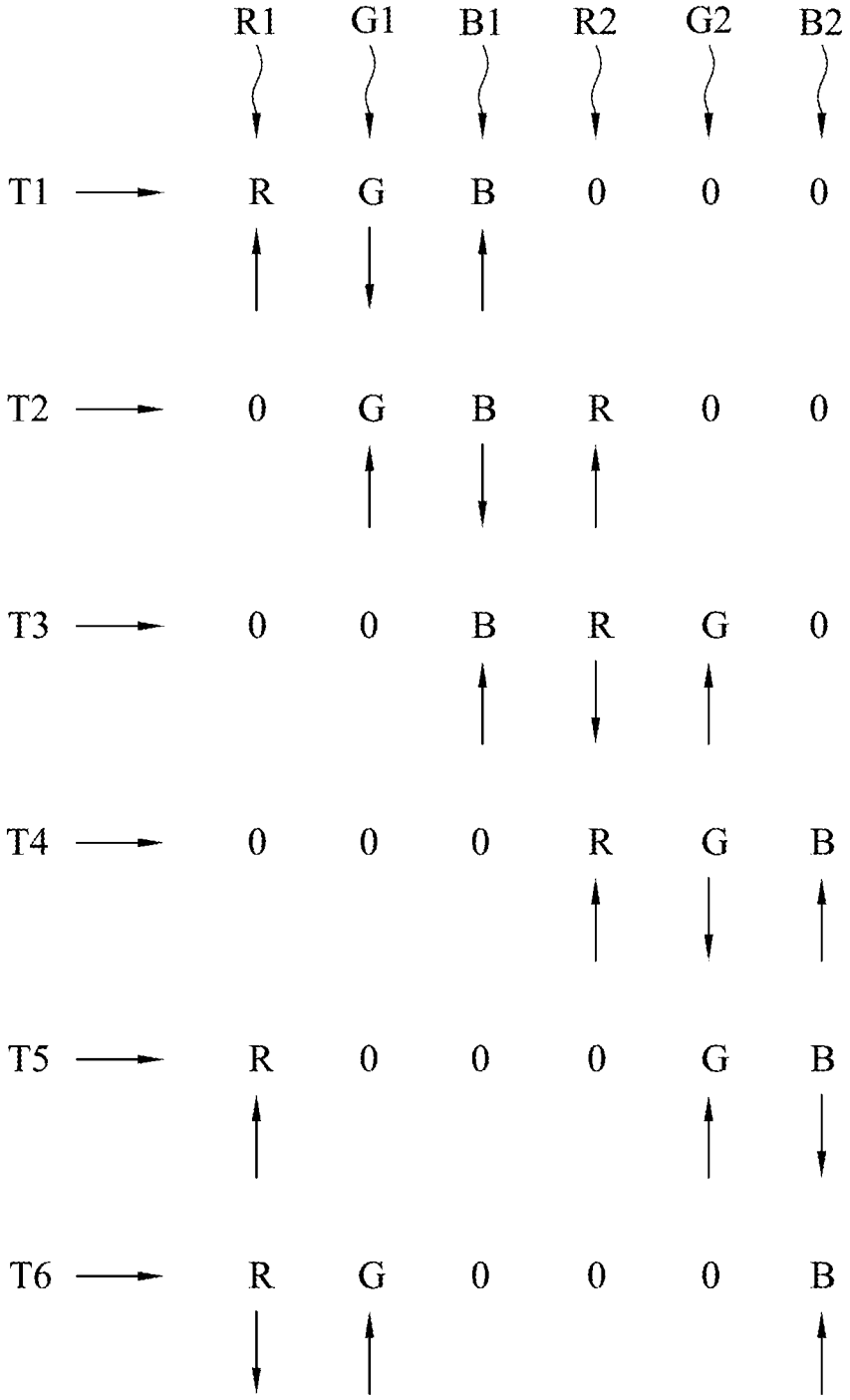

In some embodiments, after the steps (a) to (d) are performed on all the sub-pixels in a row of the input image, it is determined if the stripe counter is greater than a threshold. If the stripe counter is greater than the threshold, it means the input image has the bright stripe/dark stripe, and then the intensities of some sub-pixels have to be adjusted. How the intensities are adjusted will be described with reference of FIG. 7A and FIG. 7B. Referring to FIG. 7A and FIG. 7B, arrows "↑" represent increasing of intensities, and arrows "↓" represent decreasing of intensities. "R", "G", and "B" represent bright stripes, and "0" represent dark stripes. The intensities of the sub-pixels in the dark stripe are increased in the embodiment of FIG. 7A. During the adjustment, a block slides across the pixels in the row. Which one of the types T1-T6 that the current block belongs to is determined first.

If the intensity of the red sub-pixel R1 is equal to the maximum red value MaxR, the intensity of the green sub-pixel G1 is equal to the maximum green value MaxG, and the intensity of the blue sub-pixel B1 is equal to the maximum blue value MaxB, it means the current block belongs to the type T1. After the type T1 is determined, the intensities of the red sub-pixel R2, the green sub-pixel G2, and the blue sub-pixel B2 are increased.

If the intensity of the red sub-pixel R2 is equal to the maximum red value MaxR, the intensity of the green sub-pixel G1 is equal to the maximum green value MaxG, and the intensity of the blue sub-pixel B1 is equal to the maximum blue value MaxB, it means the current block belongs to the type T2. After the type T2 is determined, the intensities of the green sub-pixel G2, the blue sub-pixel B2, and the red sub-pixel R1 are increased.

If the intensity of the red sub-pixel R2 is equal to the maximum red value MaxR, the intensity of the green sub-pixel G2 is equal to the maximum green value MaxG, and the intensity of the blue sub-pixel B1 is equal to the maximum blue value MaxB, it means the current block belongs to the type T3. After the type T3 is determined, the intensities of the blue sub-pixel B2, the red sub-pixel R1, and the green sub-pixel G1 are increased.

If the intensity of the red sub-pixel R2 is equal to the maximum red value MaxR, the intensity of the green sub-pixel G2 is equal to the maximum green value MaxG, and the intensity of the blue sub-pixel B2 is equal to the maximum blue value MaxB, it means the current block belongs to the type T4. After the type T4 is determined, the intensities of the red sub-pixel R1, the green sub-pixel G1, and the blue sub-pixel B1 are increased.

If the intensity of the red sub-pixel R1 is equal to the maximum red value MaxR, the intensity of the green sub-pixel G2 is equal to the maximum green value MaxG, and the intensity of the blue sub-pixel B2 is equal to the maximum blue value MaxB, it means the current block belongs to the type T5. After the type T5 is determined, the intensities of the green sub-pixel G1, the blue sub-pixel B1, and the red sub-pixel R2 are increased.

If the intensity of the red sub-pixel R1 is equal to the maximum red value MaxR, the intensity of the green sub-pixel G1 is equal to the maximum green value MaxG, and the intensity of the blue sub-pixel B2 is equal to the maximum blue value MaxB, it means the current block belongs to the type T6. After the type T6 is determined, the intensities of the blue sub-pixel B1, the red sub-pixel R2, and the green sub-pixel G2 are increased.

In the embodiment of FIG. 7B, the intensity of the sub-pixel, which is adjacent to the dark stripe, in the bright stripe is increased, and the intensity of the sub-pixel, which is not adjacent to the dark stripe, in the bright stripe is decreased. The procedure to determine the types T1-T6 is the same as that of the embodiment of FIG. 7, and therefore it will not be repeated.

If it is determined that the current block belongs to the type T1, the intensity of the red sub-pixel R1 is increased, the intensity of the green sub-pixel G1 is decreased, and the intensity of the blue sub-pixel B1 is increased. If it is determined that the current block belongs to the type T2, the intensity of the green sub-pixel G1 is increased, the intensity of the blue sub-pixel B1 is decreased, and the intensity of the red sub-pixel R2 is increased. If it is determined that the current block belongs to the type T3, the intensity of the blue sub-pixel B1 is increased, the intensity of the red sub-pixel R2 is decreased, and the intensity of the green sub-pixel G2 is increased. If it is determined that the current block belongs to the type T4, the intensity of the red sub-pixel R2 is increased, the intensity of the green sub-pixel G2 is decreased, and the intensity of the blue sub-pixel B2 is increased. If it is determined that the current block belongs to the type T5, the intensity of the red sub-pixel R1 is increased, the intensity of the green sub-pixel G2 is increased, and the intensity of the blue sub-pixel B2 is decreased. If it is determined that the current block belongs to the type T6, the intensity of the blue sub-pixel B2 is increased, the intensity of the red sub-pixel R1 is decreased, and the intensity of the blue sub-pixel B1 is increased.

In some embodiments, the intensity of the sub-pixel not adjacent to the dark stripe in the bright stripe is optionally not altered, and/or the intensity of the sub-pixel not adjacent to the bright stripe in the dark stripe is optionally not altered. For example, in the type T1 of FIG. 7A, the intensity of the green sub-pixel G2 may not be altered; and/or in the type T1 of FIG. 7B, the intensity of the green sub-pixel G1 may not be altered. In some embodiments, the embodiments of FIG. 7A and FIG. 7B are combined, and that is, all the sub-pixels in the bright stripe and in the dark stripe are altered.

Referring to FIG. 6, six sub-pixels are taken as a block to detect the bright stripe and the dark stripe in the embodiment above. In the following embodiment, nine sub-pixels are taken as a block to detect the bright stripe and the dark stripe. In this case, the block may contain three stripes. For example, in the type T1, the sub-pixels R1, G1 and B1 constitute a first bright stripe; the sub-pixels R2, G2 and B2 constitute a first dark stripe; and the sub-pixels R3, G3, and B3 constitute a second bright stripe. The first dark stripe is located between the first bright stripe and the second bright stripe, and the widths of these three stripes are all equal to 3. The procedure for determining the types T1-T6 includes the following steps (a') to (g').

The step (a') includes all operations of the step (a), and additionally includes: a second red absolute difference value Diff_R2=abs(R1−R3) between the red sub-pixel R1 and red sub-pixel R3 is calculated; a second green absolute difference value Diff_G2=abs(G1−G3) between the green sub-pixel R1 and the green sub-pixel R3 is calculated; and a second blue absolute difference value Diff_B2=abs(B1−B3) between the blue sub-pixel B1 and the blue sub-pixel B3 is calculated.

The step (b') is identical to the step (b). The step (c') is identical to the step (c). In the step (d'), it is determined whether the second red absolute difference value Diff_R2 is less than or equal to a third threshold Th3. In the step (e'), it is determined whether the second green absolute difference value Diff_G2 is less than or equal to the third threshold Th3. In the step (f'), it is determined whether the second blue absolute difference value Diff_B2 is less than or equal to the third threshold Th3.

In the step (g'), it is determined whether he steps (b') to (f') are affirmative. If the steps (b') to (f') are all affirmative, a stripe counter is increased. Next, the block is shifted to the right. After the steps (a') to (g') are performed on all sub-pixels in the same row, it is determined whether the stripe counter is greater than a threshold. If the stripe counter is greater than the threshold, it means there are bright stripes/dark stripes in the input image, and then the intensities of some sub-pixels have to be adjusted. The adjustment will be described with reference of FIG. 8A and FIG. 8B.

Figure 8A:
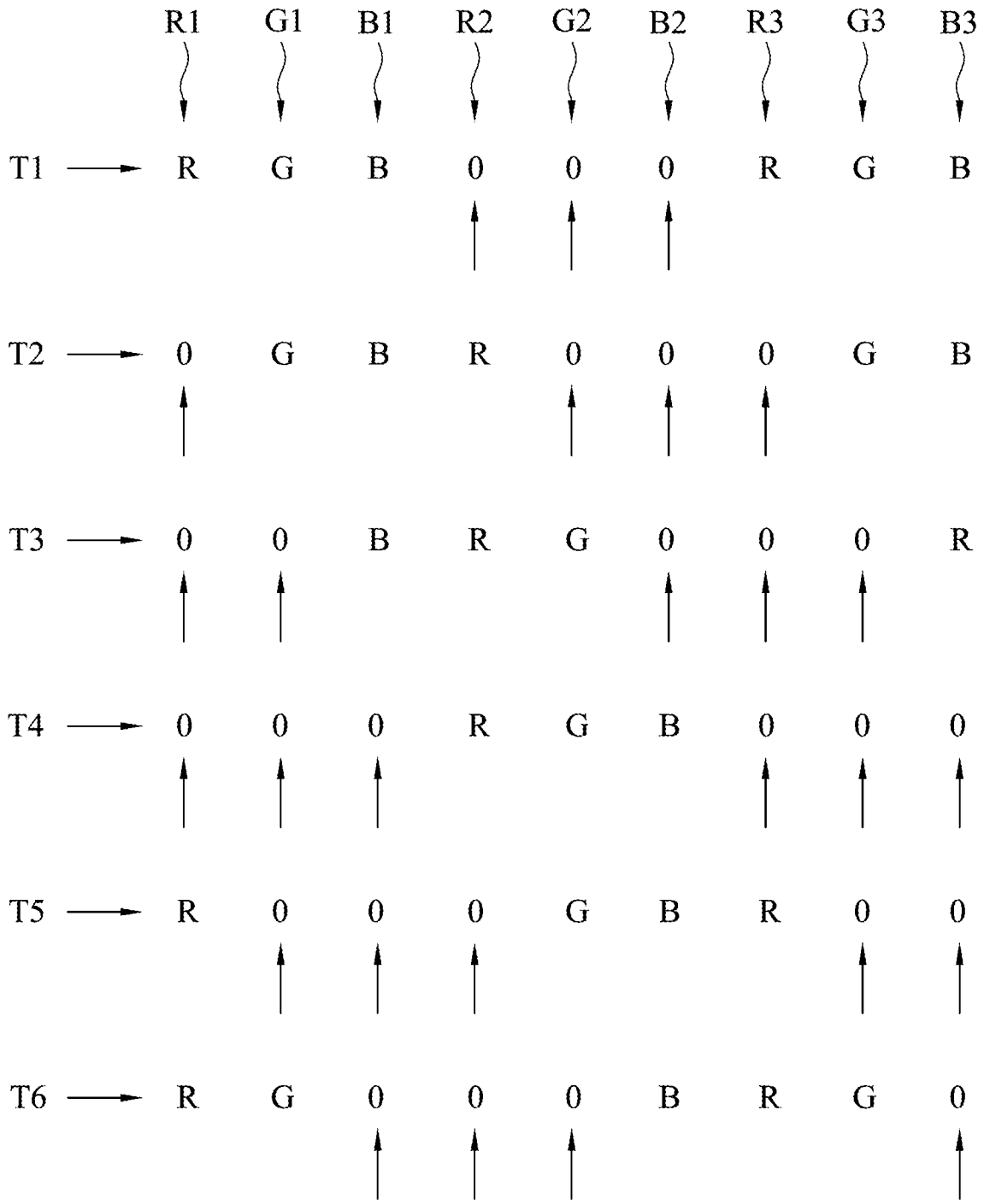
FIG. 8A and FIG. 8B are diagram illustrating the adjustment of the intensities of the sub-pixels in accordance with an embodiment.

In the embodiment of FIG. 8A, the intensities of the sub-pixels in the dark stripe are increased. Which one of the types T1-T6 that the current belongs to is determined first.

If the intensity of the red sub-pixel R1 is equal to the maximum red value MaxR, the intensity of the green sub-pixel G1 is equal to the maximum green value MaxG, and the intensity of the blue sub-pixel B1 is equal to the maximum blue value MaxB, it means the current block belongs to the type T1. After the type T1 is determined, the intensities of the red sub-pixel R2, the green sub-pixel G2, and the blue sub-pixel B2 are increased.

If the intensity of the red sub-pixel R2 is equal to the maximum red value MaxR, the intensity of the green sub-pixel G1 is equal to the maximum green value MaxG, and the intensity of the blue sub-pixel B1 is equal to the maximum blue value MaxB, it means the current block belongs to the type T2. After the type T2 is determined, the intensities of the green sub-pixel G2, the blue sub-pixel B2, the red sub-pixel R3, and the red sub-pixel R1 are increased.

If the intensity of the red sub-pixel R2 is equal to the maximum red value MaxR, the intensity of the green sub-pixel G2 is equal to the maximum green value MaxG, and the intensity of the blue sub-pixel B1 is equal to the maximum blue value MaxB, it means the current block belongs to the type T3. After the type T3 is determined, the intensities of the blue sub-pixel B2, the red sub-pixel R3, the green sub-pixel G3, the red sub-pixel R1, and the green sub-pixel G1 are increased.

If the intensity of the red sub-pixel R2 is equal to the maximum red value MaxR, the intensity of the green sub-pixel G2 is equal to the maximum green value MaxG, and the intensity of the blue sub-pixel B2 is equal to the maximum blue value MaxB, it means the current block belongs to the type T4. After the type T4 is determined, the intensities of the red sub-pixel R1, the green sub-pixel G1, the blue sub-pixel B1, the red sub-pixel R3, the green sub-pixel G3, and the blue sub-pixel B3 are increased.

If the intensity of the red sub-pixel R3 is equal to the maximum red value MaxR, the intensity of the green sub-pixel G2 is equal to the maximum green value MaxG, and the intensity of the blue sub-pixel B2 is equal to the maximum blue value MaxB, it means the current block belongs to the type T5. After the type T5 is determined, the intensities of the green sub-pixel G3, the blue sub-pixel B3, the green sub-pixel G1, the blue sub-pixel B1, and the red sub-pixel R2 are increased.

If the intensity of the red sub-pixel R3 is equal to the maximum red value MaxR, the intensity of the green sub-pixel G3 is equal to the maximum green value MaxG, and the intensity of the blue sub-pixel B2 is equal to the maximum blue value MaxB, it means the current block belongs to the type T6. After the type T6 is determined, the intensities of the blue sub-pixel B1, the red sub-pixel R2, the green sub-pixel G2, and the red sub-pixel R3 are increased.

Figure 8B:
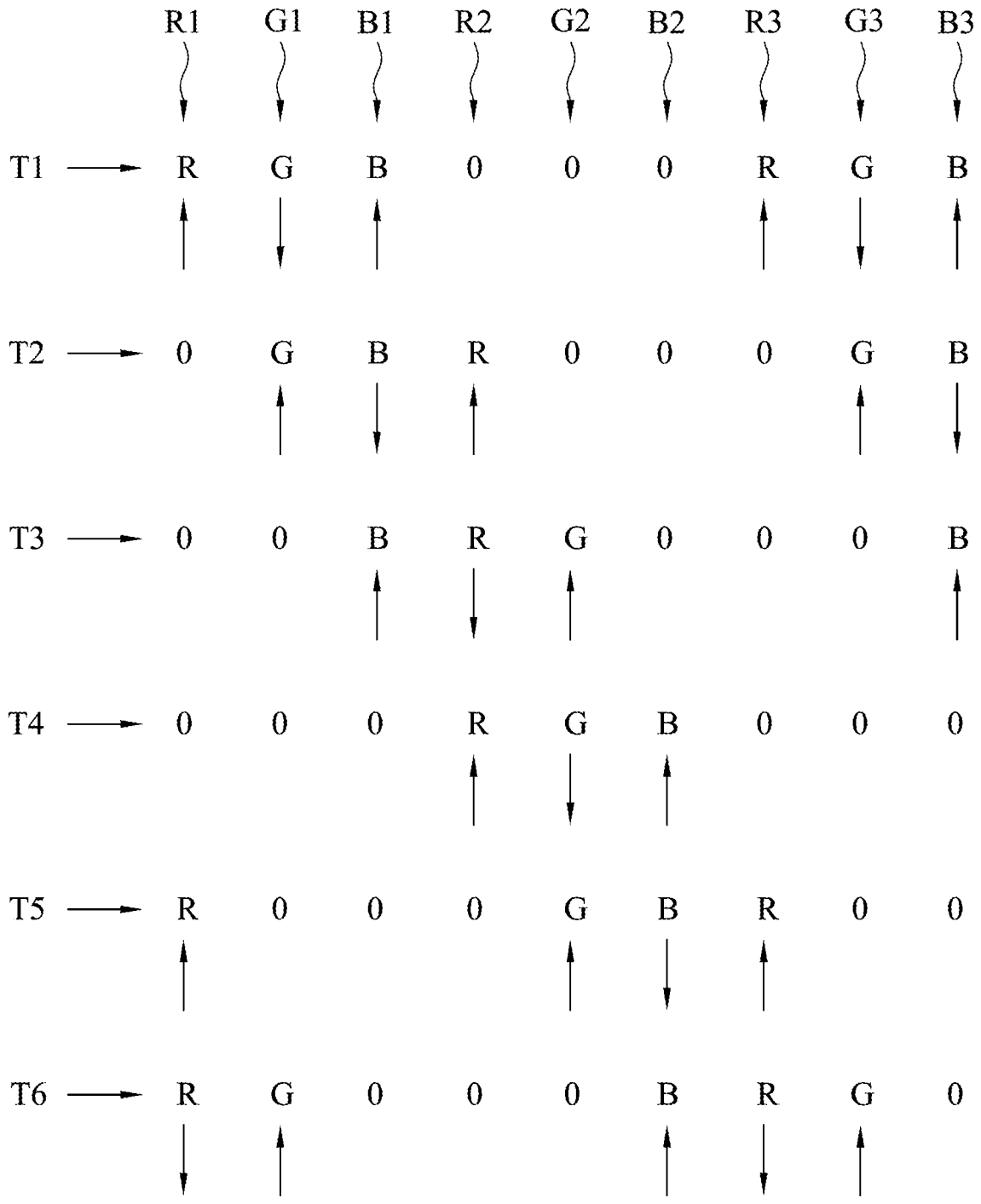

Referring to FIG. 8B, in the embodiment of FIG. 8B, the intensity of the sub-pixel adjacent to the dark stripe in the bright stripe is increased, and the intensity of the sub-pixel not adjacent to the dark stripe in the bright stripe is decreased. The procedure for determining the types T1-T6 is the same as that of the embodiment of FIG. 8A, and therefore it will not be repeated.

If it is determined that the current block belongs to the type T1, the intensity of the red sub-pixel R1 is increased, the intensity of the green sub-pixel G1 is decreased, the intensity of the blue sub-pixel B1 is increased, the intensity of the red sub-pixel R3 is increased, the intensity of the green sub-pixel G3 is decreased, the intensity of the blue sub-pixel B3 is increased. If it is determined that the current block belongs to the type T2, the intensity of the green sub-pixel G1 is increased, the intensity of the blue sub-pixel B1 is decreased, the intensity of the red sub-pixel R2 is increased, the intensity of the green sub-pixel G3 is increased, and the intensity of the blue sub-pixel B3 is decreased. If it is determined that the current block belongs to the type T3, the intensity of the blue sub-pixel B1 is increased, the intensity of the red sub-pixel R2 is decreased, the intensity of the green sub-pixel G2 is increased, and the intensity of the blue sub-pixel B3 is increased. If it is determined that the current block belongs to the type T4, the intensity of the red sub-pixel R2 is increased, the intensity of the green sub-pixel G2 is decreased, and the intensity of the blue sub-pixel B2 is increased. If it is determined that the current block belongs to the type T5, the intensity of the red sub-pixel R1 is increased, the intensity of the green sub-pixel G2 is increased, the intensity of the blue sub-pixel B2 is decreased, and the intensity of the red sub-pixel R3 is increased. If it is determined that the current block belongs to the type T6, the intensity of the red sub-pixel R1 is decreased, the intensity of the green sub-pixel G1 is decreased, the intensity of the blue sub-pixel B2 is increased, the intensity of the red sub-pixel R3 is decreased, and the intensity of the green sub-pixel G3 is increased.

In some embodiments, the intensities of the sub-pixels not adjacent to the dark stripe in the bright stripe are optionally not altered, and/or the intensities of the sub-pixel not adjacent to the bright stripe in the dark stripe are optionally not altered. For example, in the type T3 of FIG. 8A, the intensities of the red sub-pixels R1 and R3 may not be altered; and in the type T6 of FIG. 8B, the intensities of the red sub-pixels R1 and R3 may not be altered. In some embodiments, the embodiments of FIG. 8A and FIG. 8B are combined, and that is, all the sub-pixels in the bright stripe and in the dark stripe are altered.

In the embodiments, each pixel includes three sub-pixels, and therefore the sub-pixel not adjacent to the dark stripe in the bright stripe may be referred to as a middle sub-pixel, and the sub-pixel not adjacent to the dark stripe in the bright stripe may be referred to as the middle sub-pixel. In some embodiments, the intensity of the middle sub-pixel in the bright stripe is set according to the intensity of the sub-pixel adjacent to the dark stripe in the bright stripe. For example, in the type T1 of FIG. 7B, the intensity of the blue sub-pixel B1 is multiplied by a real number and then set as the intensity of the green sub-pixel G1. The real number is, for example, less than or equal to 1, but the invention is not limited thereto. Alternatively, in the type T1 of FIG. 8B, the intensity of the red sub-pixel R3 is multiplied by the real number and then set as the intensity of the green sub-pixel G3, and so on. Similarly, the intensity of the middle sub-pixel in the dark stripe may be set according to the intensity of the sub-pixel adjacent to the bright stripe in the dark stripe. For example, in the type T1 of FIG. 7A, the intensity of the red sub-pixel R2 is multiplied by the real number and then set as the intensity of the green sub-pixel G2. Alternatively, in the type T1 of FIG. 8A, the intensity of the red sub-pixel R2 may be multiplied by the real number and then set as the intensity of the green sub-pixel G2.

In some embodiments, when adjusting the intensity of the sub-pixel adjacent to the dark stripe in the bright stripe, the intensity is increased according to a gain value which is calculated according to the stripe counter. Similarly, the gain value may be used to increase the intensity of the sub-pixel adjacent to the bright stripe in the dark stripe. The gain value is proportional to the stripe counter. The larger the stripe counter is, the more the sub-pixels are affected by the capacitor coupling, and therefore the amplitude of the adjustment has to be larger. Take the type T1 of FIG. 7B as an example, an absolute intensity difference abs(B1−R2) between the blue sub-pixel B1 and the red sub-pixel R2 is inputted into a lookup table to obtain a shift value. The shift value is multiplied by a gain value to obtain a modified shift value. Next, the intensity of the blue sub-pixel B1 is increased according to the modified shift value. The said operations can be represented as pseudocode: B1=B1+round (LUT(abs(B1−R2))*LUT(LineStripe)/256). LUT(x) represents inputting a variable x into a lookup table. round( ) represents a round function. LUT(LineStripe)/256 is the gain value which is proportional to the stripe counter LineStripe. Take the type T2 of FIG. 7A as an example, an absolute intensity difference abs(R2−G2) between the red sub-pixel R2 and the green sub-pixel G2 is inputted into a lookup table to obtain a shift value. The shift value is multiplied by a gain value to obtain a modified shift value. The intensity of the blue sub-pixel B1 is increased according to the modified shift value. The said operations can be represented as pseudocode: G2=G2+round(LUT(abs(R2−G2))*LUT(LineStripe)/256). Take the type T4 of FIG. 8A as an example, an absolute intensity difference abs(B1−R2) between the blue sub-pixel B1 and red sub-pixel R2 is inputted into a lookup table to obtain a shift value. The shift value is multiplied by a gain value to obtain a modified shift value. The intensity of the blue sub-pixel B1 is increase according to the modified shift value. Take the type T5 of FIG. 8B as an example, an absolute intensity difference abs(R2−G2) between the red sub-pixel R2 and the green sub-pixel G2 is inputted into a lookup table to obtain a shift value. The shift value is multiplied by a gain value to obtain a modified shift value. The intensity of the green sub-pixel G2 is increased according to the modified shift value.

In the embodiments, six or nine sub-pixels are taken as a block to detect the capacitor coupling. In addition, the intensities of the sub-pixels in the edges of the bright stripe and the dark stripe are increased. As a result, the problem of color shift is addressed.

Figure 9:
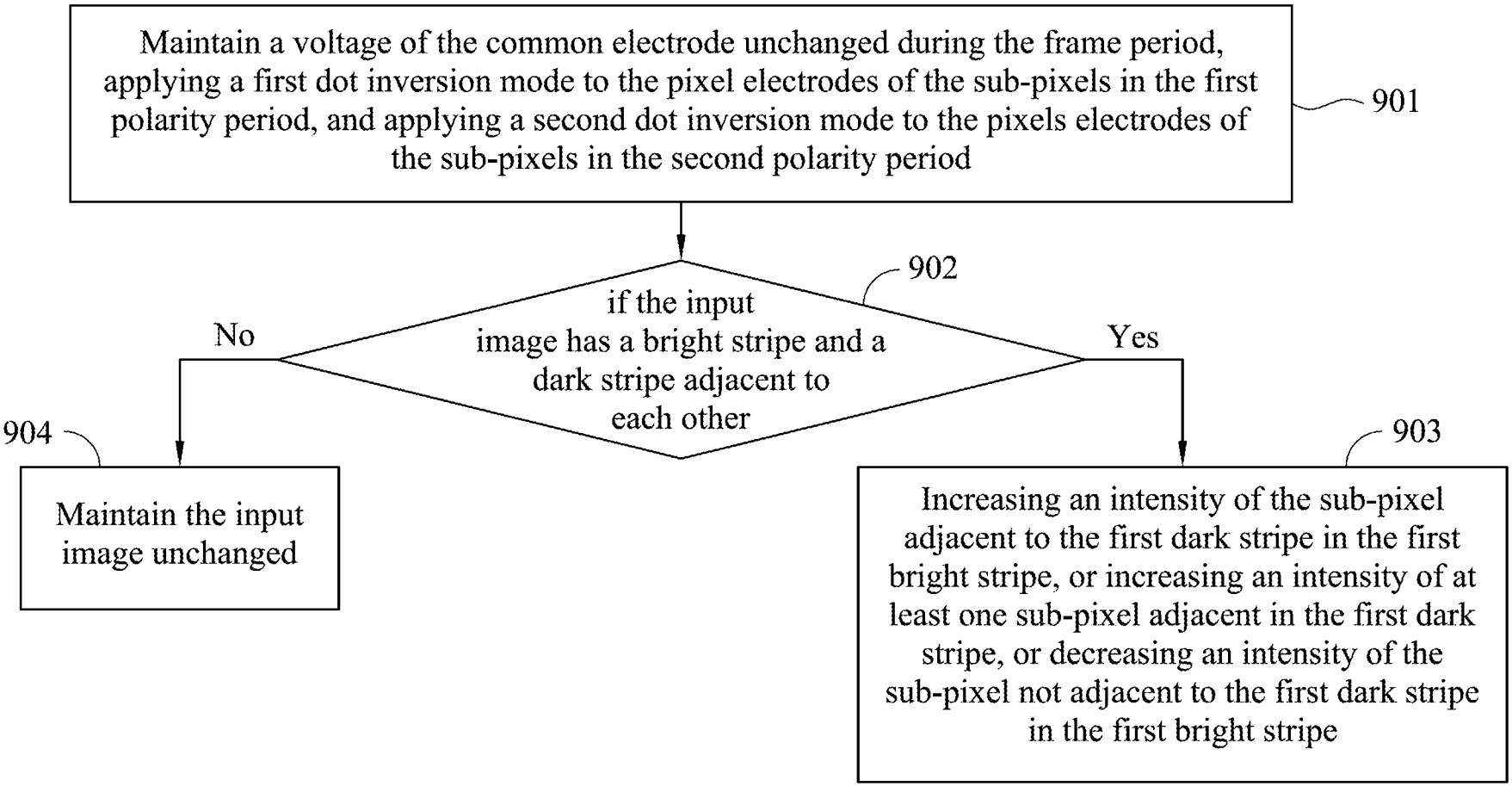
FIG. 9 is a flow chart of an image processing method in accordance with an embodiment.

FIG. 9 is a flow chart of an image processing method in accordance with an embodiment. The image processing method is for the display device and performed by any suitable circuit in the display device. In step 901, a voltage of the common electrode is maintained unchanged during the frame period, a first dot inversion mode is applied to the pixel electrodes of the sub-pixels in the first polarity period, and a second dot inversion mode is applied to the pixels electrodes of the sub-pixels in the second polarity period. In step 902, whether the input image has a bright stripe and a dark stripe adjacent to each other is determined. If the step 902 is affirmative, the step 903 is performed to increase an intensity of the sub-pixel adjacent to the first dark stripe in the first bright stripe, or increase an intensity of at least one sub-pixel adjacent in the first dark stripe, or decrease an intensity of the sub-pixel not adjacent to the first dark stripe in the first bright stripe. If the step 902 is negative, the step 904 is performed, in which the input image is not changed. However, all the steps in FIG. 9 have been described in detail above, and therefore they will not be repeated. Note that the steps in FIG. 9 can be implemented as program codes or circuits, and the disclosure is not limited thereto. In addition, the method in FIG. 9 can be performed with the aforementioned embodiments, or can be performed independently. In other words, other steps may be inserted between the steps of the FIG. 9.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display device, comprising:

at least one circuit; and a plurality of pixels, wherein each of the pixels comprises a plurality of sub-pixels, and each of the sub-pixels comprises a pixel electrode and a portion of a common electrode, wherein the at least one circuit is configured to obtain an input image comprising a plurality of intensities, and each of the intensities corresponds to one of the sub-pixels, wherein a frame period comprises a first polarity period and a second polarity period, the at least one circuit maintains a voltage of the common electrode unchanged during the frame period, and applies a first dot inversion mode to the pixel electrodes of the sub-pixels in the first polarity period, and applies a second dot inversion mode to the pixels electrodes of the sub-pixels in the second polarity period, wherein the first dot inversion mode is different from the second dot inversion mode, wherein the at least one circuit determines if the input image has a first bright stripe and a first dark stripe adjacent to each other, wherein if determining that the input image has the first bright stripe and the first dark stripe adjacent to the each other, the at least one circuit calculates an absolute intensity difference between the first bright stripe and the first dark stripe, and increases the intensity of the sub-pixel adjacent to the first dark stripe in the first bright stripe according to the absolute intensity difference and a stripe counter or increases the intensity of the sub-pixel adjacent to the first bright stripe in the first dark stripe according to the absolute intensity difference and the stripe counter, wherein an amplitude of an adjustment of the intensity of the sub-pixel adjacent to the first dark stripe in the first bright stripe or an adjustment of the intensity of the sub-pixel adjacent to the first bright stripe in the first dark stripe is positively correlated to the absolute intensity difference and the stripe counter, wherein the input image comprises a first red sub-pixel, a first green sub-pixel, a first blue sub-pixel, a second red sub-pixel, a second green sub-pixel and a second blue sub-pixel which are sequentially disposed in a same row, and the operation of the at least one circuit determining if the input image has the first bright stripe and the first dark stripe adjacent to the each other comprises:

(a) calculating a maximum red value of the first red sub-pixel and the second red sub-pixel, calculating a maximum green value of the first green sub-pixel and the second green sub-pixel, calculating a maximum blue value of the first blue sub-pixel and the second blue sub-pixel, calculating a red absolute difference value between the first red sub-pixel and the second red sub-pixel, calculating a green absolute difference value between the first green sub-pixel and the second green sub-pixel, and calculating a blue absolute difference value between the first blue sub-pixel and the second blue sub-pixel;

(b) determining if a maximum of the maximum red value, the maximum green value and the maximum blue value minus a minimum of the maximum red value, the maximum green value and the maximum blue value is less than or equal to a first threshold;

(c) determining if a maximum of the red absolute difference value, the green absolute difference value and the blue absolute difference value minus a minimum of the red absolute difference value, the green absolute difference value and the blue absolute difference value is less than or equal to a second threshold; and (d) increasing the stripe counter if the step (b) and the step (c) are affirmative.

2. The display device of claim 1, wherein the at least one circuit calculates a gain value according to the stripe counter, and the at least one circuit increases the intensity of the sub-pixel adjacent to the first dark stripe in first bright stripe according to the gain value, or increases the intensity of the sub-pixel adjacent to the first bright stripe in the first dark stripe according to the gain value.

3. The display device of claim 2, wherein the at least one circuit inputs the absolute intensity difference between the first bright stripe and the first dark stripe into a lookup table to obtain a shift value, and multiplies the shift value by the gain value to obtain a modified shift value, and the at least one circuit increases the intensity of the sub-pixel adjacent to the first dark stripe in first bright stripe according to the modified shift value, or increases the intensity of the sub-pixel adjacent to the first bright stripe in the first dark stripe according to the modified shift value.

4. The display device of claim 1, wherein the at least one circuit sets the intensity of the sub-pixel not adjacent to the first dark stripe in the first bright stripe according to the intensity of the sub-pixel adjacent to the first dark stripe in the first bright stripe, and the at least one circuit sets the intensity of the sub-pixel not adjacent to the first bright stripe in the first dark stripe according to the intensity of the sub-pixel adjacent to the first bright stripe in the first dark stripe.

5. The display device of claim 1, wherein the at least one circuit determines if the input image has the first bright stripe, the first dark stripe and a second bright stripe, wherein the first dark stripe is located between the first bright stripe and the second bright stripe, wherein if determining that the input image has the first bright stripe, the first dark stripe and the second bright stripe, the at least one circuit increases the intensity of the sub-pixel adjacent to the first dark stripe in the second bright stripe, or increases the intensity of the sub-pixel adjacent to the second bright stripe in the first dark stripe, or decreases the intensity of the sub-pixel not adjacent to the first dark stripe in the second bright stripe.

6. The display device of claim 5, wherein the at least one circuit sets the intensity of the sub-pixel not adjacent to the first dark stripe in the first bright stripe according to the intensity of the sub-pixel adjacent to the first dark stripe in first bright stripe, or the at least one circuit sets the intensity of the sub-pixel not adjacent to the first bright stripe and the second bright stripe in the first dark stripe according to the intensity of the sub-pixel adjacent to the first bright stripe or the second bright stripe in the first dark stripe, or the at least one circuit sets the intensity of the sub-pixel not adjacent to the first bright stripe in the second bright stripe according to the intensity of the sub-pixel adjacent to the first dark stripe in the second bright stripe.

7. The display device of claim 1, wherein each of the pixels comprises n sub-pixels, n is a positive integer, and both widths of the first bright stripe and the first dark stripe are equal to the positive integer n.

8. The display device of claim 1, wherein the at least one circuit is a timing controller.

9. An image processing method for a display device comprising a plurality of pixels, wherein each of the pixels comprises a plurality of sub-pixels, each of the sub-pixels comprises a pixel electrode and a portion of a common electrode, a frame period comprises a first polarity period and a second polarity period, and the image processing method comprises:

maintaining a voltage of the common electrode unchanged during the frame period, applying a first dot inversion mode to the pixel electrodes of the sub-pixels in the first polarity period, and applying a second dot inversion mode to the pixels electrodes of the sub-pixels in the second polarity period, wherein the first dot inversion mode is different from the second dot inversion mode;

determining if an input image comprising a plurality of intensities has a first bright stripe and a first dark stripe adjacent to each other, wherein each of the intensities corresponds to one of the sub-pixels; and if determining that the input image has the first bright stripe and the first dark stripe adjacent to the each other, calculating an absolute intensity difference between the first bright stripe and the first dark stripe, and increasing the intensity of the sub-pixel adjacent to the first dark stripe in the first bright stripe according to the absolute intensity difference and a stripe counter or increasing the intensity of the sub-pixel adjacent to the first bright stripe in the first dark stripe according to the absolute intensity difference and the stripe counter, wherein an amplitude of an adjustment of the intensity of the sub-pixel adjacent to the first dark stripe in the first bright stripe or an adjustment of the intensity of the sub-pixel adjacent to the first bright stripe in the first dark stripe is positively correlated to the absolute intensity difference and the stripe counter, wherein the input image comprises a first red sub-pixel, a first green sub-pixel, a first blue sub-pixel, a second red sub-pixel, a second green sub-pixel and second blue sub-pixel which are sequentially disposed in a same row, and the step of determining if the input image has the first bright stripe and the first dark stripe adjacent to the each other comprises:

(a) calculating a maximum red value of the first red sub-pixel and the second red sub-pixel, calculating a maximum green value of the first green sub-pixel and the second green sub-pixel, calculating a maximum blue value of the first blue sub-pixel and the second blue sub-pixel, calculating a red absolute difference value between the first red sub-pixel and the second red sub-pixel, calculating a green absolute difference value between the first green sub-pixel and the second green sub-pixel, and calculating a blue absolute difference value between the first blue sub-pixel and the second blue sub-pixel;

(b) determining if a maximum of the maximum red value, the maximum green value and the maximum blue value minus a minimum of the maximum red value, the maximum green value and the maximum blue value is less than or equal to a first threshold;

(c) determining if a maximum of the red absolute difference value, the green absolute difference value and the blue absolute difference value minus a minimum of the red absolute difference value, the green absolute difference value and the blue absolute difference value is less than or equal to a second threshold; and (d) increasing the stripe counter is the step (b) and the step (c) are affirmative.

10. The image processing method of claim 9, further comprising:

calculating a gain value according to the stripe counter; and increasing the intensity of the sub-pixel adjacent to the first dark stripe in first bright stripe according to the gain value, or increasing the intensity of the sub-pixel adjacent to the first bright stripe in the first dark stripe according to the gain value.

11. The image processing method of claim 10, further comprising:

inputting the absolute intensity difference between the first bright stripe and the first dark stripe to a lookup table to obtain a shift value, and multiplying the shift value by the gain value to obtain a modified shift value; and increasing the intensity of the sub-pixel adjacent to the first dark stripe in first bright stripe according to the modified shift value, or increasing the intensity of the sub-pixel adjacent to the first bright stripe in the first dark stripe according to the modified shift value.

12. The image processing method of claim 9, further comprising:

setting the intensity of the sub-pixel not adjacent to the first dark stripe in the first bright stripe according to the intensity of the sub-pixel adjacent to the first dark stripe in first bright stripe; or setting the intensity of the sub-pixel not adjacent to the first bright stripe in the first dark stripe according to the intensity of the sub-pixel adjacent to the first bright stripe in the first dark stripe.

13. The image processing method of claim 9, further comprising:

determining if the input image has the first bright stripe, the first dark stripe and a second bright stripe, wherein the first dark stripe is located between the first bright stripe and the second bright stripe; and if determining that the input image has the first bright stripe, the first dark stripe and the second bright stripe, increasing the intensity of the sub-pixel adjacent to the first dark stripe in the second bright stripe, or increasing the intensity of the sub-pixel adjacent to the second bright stripe in the first dark stripe, or decreasing an intensity of the sub-pixel not adjacent to the first dark stripe in the second bright stripe.

14. The image processing method of claim 13, further comprising:

setting the intensity of the sub-pixel not adjacent to the first dark stripe in the first bright stripe according to the intensity of the sub-pixel adjacent to the first dark stripe in first bright stripe;

setting the intensity of the sub-pixel not adjacent to the first bright stripe and the second bright stripe in the first dark stripe according to the intensity of the sub-pixel adjacent to the first bright stripe or the second bright stripe in the first dark stripe; or setting the intensity of the sub-pixel not adjacent to the first bright stripe in the second bright stripe according to the intensity of the sub-pixel adjacent to the first dark stripe in the second bright stripe.

* * * * *